US009816477B2

(12) United States Patent
Toda

(10) Patent No.: US 9,816,477 B2
(45) Date of Patent: Nov. 14, 2017

(54) APPARATUS AND METHOD FOR CONTROLLING POWER SUPPLY TO GLOW PLUG

(71) Applicant: NGK SPARK PLUG CO., LTD., Nagoya-shi, Aichi (JP)

(72) Inventor: Satoru Toda, Inazawa (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 15/131,501

(22) Filed: Apr. 18, 2016

(65) Prior Publication Data

US 2016/0377044 A1 Dec. 29, 2016

(30) Foreign Application Priority Data

Jun. 25, 2015 (JP) ..... 2015-127347

(51) Int. Cl.

*H05B 1/02* (2006.01)
*F02P 19/02* (2006.01)
*F02P 11/06* (2006.01)

(52) U.S. Cl.

CPC ..... *F02P 19/021* (2013.01); *F02P 19/027* (2013.01); *F02P 11/06* (2013.01); *F02P 19/022* (2013.01); *F02P 19/023* (2013.01)

(58) Field of Classification Search

CPC ..... F02P 19/021; F02P 19/027; F02P 19/022; F02P 19/023; H05B 1/0236; H05B 3/0042

(Continued)

(56) References Cited

U.S. PATENT DOCUMENTS 4,235,215 A 11/1980 Stotz et al. ..... 123/179 H
4,677,282 A * 6/1987 Walsh ..... G05D 23/1909 219/494

(Continued)

FOREIGN PATENT DOCUMENTS

DE 42 44 166 C1 3/1994 ..... H01H 47/00
EP 2 489 871 8/2012 ..... F02P 19/02

(Continued)

OTHER PUBLICATIONS

Extended European Search Report issued in corresponding European Patent Application No. 16166106.1 dated Nov. 14, 2016.

*Primary Examiner* — Mark Paschall
(74) *Attorney, Agent, or Firm* — Kusner & Jaffe

(57) ABSTRACT

Disclosed is a control apparatus for controlling power supply from a power source to a glow plug, including a plurality of semiconductor switching elements arranged to turn on and of power supply to the glow plug, a temperature fuse actuated by a temperature rise thereof to interrupt power supply to the semiconductor switching elements, a failure detection portion that detects the occurrence or non-occurrence of an ON failure in each of the semiconductor switching elements, and a control portion that performs drive control of the semiconductor switching elements. When the failure detection portion detects the ON failure in at least one of the semiconductor switching elements, the control portion increases the amount of heat generation of either the at least one of the semiconductor switching elements in which the ON failure is detected or any of the semiconductor switching elements in which the ON failure is not detected.

6 Claims, 8 Drawing Sheets

(58) Field of Classification Search
USPC ..... 219/497, 499, 501, 202, 205, 206
See application file for complete search history.

(56) References Cited

U.S. PATENT DOCUMENTS

| | | | | |
|---|---|---|---|---|
| 6,148,258 | A * | 11/2000 | Boisvert | F02P 19/022 123/145 A |
| 6,555,796 | B1 * | 4/2003 | Cusack | H05B 1/0283 219/481 |
| 7,291,814 | B2 * | 11/2007 | Oishi | B62J 33/00 219/202 |
| 2009/0127249 | A1 | 5/2009 | Bauer et al. | 219/494 |
| 2017/0001526 | A1 * | 1/2017 | Kawaguchi | H02J 1/08 |

FOREIGN PATENT DOCUMENTS

| | | | |
|---|---|---|---|
| FR | 2 408 735 A1 | 6/1979 | F02P 19/02 |
| JP | 2008-530727 | 8/2008 | F02P 19/00 |
| JP | 2012-172568 | 9/2012 | F02P 19/02 |

* cited by examiner

APPARATUS AND METHOD FOR CONTROLLING POWER SUPPLY TO GLOW PLUG

BACKGROUND OF THE INVENTION

The present invention relates to control of power supply to a glow plug.

Glow plugs are used to aid ignition in diesel engines. There is conventionally known an energization control apparatus for a glow plug, which includes a semiconductor switching element to turn on and off energization of the glow plug. This type of glow plug energization control apparatus is sometimes provided with a temperature fuse so as to suppress abnormal overheating in the event of a failure in the semiconductor switching element. For example, Japanese Unexamined Patent Publication (Translation of PCT Application) No. 2008-530727 (hereinafter abbreviated as "Patent Document 1") discloses a glow plug energization control apparatus provided with a semiconductor switching element and a temperature fuse in which, when the semiconductor switching element reaches a high temperature upon the occurrence of a failure, the temperature fuse becomes disconnected by the action of a spring element. Japanese Unexamined Patent Publication No. 2012-172568 (hereinafter abbreviated as "Patent Document 2") discloses a glow plug energization control apparatus provided with a semiconductor switching element, a temperature fuse and a reverse connection protection FET (field effect transistor) in which, upon detection of a failure in the semiconductor switching element, the reverse connection protection FET causes heat generation by the passage of electric current through a parasitic diode of the reverse connection protection FET so as to disconnect the temperature fuse.

SUMMARY OF THE INVENTION

The control apparatus of Patent Document 1 has the problem of limited flexibility in substrate design because the temperature fuse and the semiconductor switching element need to be arranged adjacent to each other so as to transfer heat of the semiconductor switching element to the temperature fuse. In the case where the control apparatus has a plurality of semiconductor switching elements on one temperature fuse, some of the semiconductor switching elements may not he arranged adjacent to the temperature fuse so that, when any of these some semiconductor switching elements fails in an ON state and becomes overheated, it takes a long time to actuate the temperature fuse due to slow temperature rise of the temperature fuse. (Hereinafter, the status in which the semiconductor switching element is failing while being in its ON state is referred to as "ON failure".) This results in the problem of burnout of the semiconductor switching element or substrate by overheating. It is alternatively conceivable to arrange a plurality of temperature fuses adjacent to the respective semiconductor switching elements. In such a case, however, the control apparatus has the problem of increase in production cost and increase in substrate area.

The control apparatus of Patent Document 2 has the problem that it is difficult to control the heat generation temperature of the reverse connection protection FET and the time lapsed until interruption of the power supply to the glow plug.

There has thus been a demand to develop a technique for, while minimizing the production cost of the control apparatus, more stably actuating the temperature fuse and securely interrupting power supply to the glow plug before burnout of the semiconductor switching element or substrate by abnormal overheating.

The present invention has been made to solve the above-mentioned problems and can be embodied by the following Configurations.

Configuration [1]

A control apparatus for controlling power supply from a power source to a glow plug, comprising:

a plurality of semiconductor switching elements electrically connected to the power source and to the glow plug so as to turn on and off power supply to the glow plug;

a temperature fuse arranged between the power source and the semiconductor switching elements and actuated by a temperature rise thereof so as to interrupt power supply to the semiconductor switching elements;

a failure detection portion that detects the occurrence or non-occurrence of an ON failure in each of the semiconductor switching elements; and a control portion that outputs drive signals for ON/OFF drive control of the semiconductor switching elements, wherein, when the failure detection portion detects the ON failure in at least one of the semiconductor switching elements, the control portion controls any of the semiconductor switching elements in which no ON failure is detected and thereby increases the amount of heat generation of either the at least one of the semiconductor switching elements in which the ON failure is detected or the any of the semiconductor switching elements in which no ON failure is detected.

In configuration [1], the control apparatus is configured to, upon detection of the ON failure in at least one of the semiconductor switching elements, increase the amount of heat generation of either the semiconductor switching element in which the ON failure is detected or the semiconductor switching element(s) in which the ON failure is not detected. With such increase of heat generation, it is possible to heat the temperature fuse to a higher temperature and more stably actuate the temperature fuse. It is also possible to minimize the production cost of the control apparatus since the control apparatus is provided with one temperature fuse to protect the plurality of semiconductor switching elements.

Configuration [2]

The control apparatus according to configuration 1, wherein a plurality of the glow plugs are connected electrically in parallel to each other;

wherein the semiconductor switching elements are electrically connected in parallel to each other and are electrically connected in series to the glow plugs; and wherein, when the failure detection portion detects the ON failure in at least one of the semiconductor switching elements, the control portion turns of any of the semiconductor switching elements in which no ON failure is detected and thereby increases the amount of heat generation of the at least one of the semiconductor switching elements in which the ON failure is detected.

In configuration [2], the control apparatus is configured to, upon detection of the ON failure in at least one of the semiconductor switching elements, turn off any of the semiconductor switching elements in which the ON failure is not detected. It is possible by this control to concentrate a large amount of electric, current on the semiconductor switching element in which the ON failure is detected and easily increase the amount of heat generation of such a failing semiconductor switching element.

Configuration [3]

The control apparatus according to configuration 1, wherein the semiconductor switching elements are electrically connected in parallel to each other and are respectively electrically connected in series to a plurality of the glow plugs; and wherein, when the failure detection portion detects the ON failure in at least one of the semiconductor switching elements, the control portion increases the amount of heat generation of at least one of any of the semiconductor switching elements in which no ON failure is detected.

In configuration [3], the control apparatus is configured to, upon detection of the ON failure in at least one of the semiconductor switching elements, increase the amount of heat generation of any of the semiconductor switching elements in which the ON failure is not detected. It is possible by this control to stably actuate the temperature fuse even in the ease where the glow plugs are not electrically connected in parallel to each other.

Configuration [4]

The control apparatus according to configuration 3, wherein, when the failure detection portion detects the ON failure in the at least one of the semiconductor switching elements, the control portion decreases the voltage level of the drive signal outputted to the at least one of any of the semiconductor switching elements in which no ON failure is detected and thereby increases the amount of heat generation of the at least one of the any of the semiconductor switching elements in which no ON failure is detected.

In configuration [4], the control apparatus is configured to, upon detection of the ON failure in at least one of the semiconductor switching elements, decrease the voltage level of the drive signal outputted to any of the semiconductor switching elements in which the ON failure is not detected. It is possible by this control to increase the ON resistance of the semiconductor switching element in which the ON failure is not detected and easily increase the amount of heat generation of such a normally functioning semiconductor switching element.

Configuration [5]

The control apparatus according to configuration 3, wherein, when the failure detection portion detects the ON failure in the at least one of the semiconductor switching elements, the control portion increases the frequency of the drive signal outputted to the at least one of any of the semiconductor switching elements in which no ON failure is detected and thereby increases the amount of heat generation of the at least one of the any of the semiconductor switching elements in which no ON failure is detected.

In configuration [5], the control apparatus is configured to, upon detection of the ON failure in at least one of the semiconductor switching elements, increase the frequency of the drive signal outputted to any of the semiconductor switching elements in which the ON failure is not detected. It is possible by this control to increase the switching loss of the semiconductor switching element in which the ON failure is not detected and easily increase the amount of heat generation of such a normally functioning semiconductor switching element.

It is feasible to embody the present invention in various forms such as, not only a glow plug control apparatus, but also a glow plug control method.

The other objects and features of the present invention will also become understood from the following description.

DESCRIPTION OF THE EMBODIMENTS

The present invention will be described below with reference to the drawings.

A. First Embodiment

A-1. System Configuration

Figure 1:
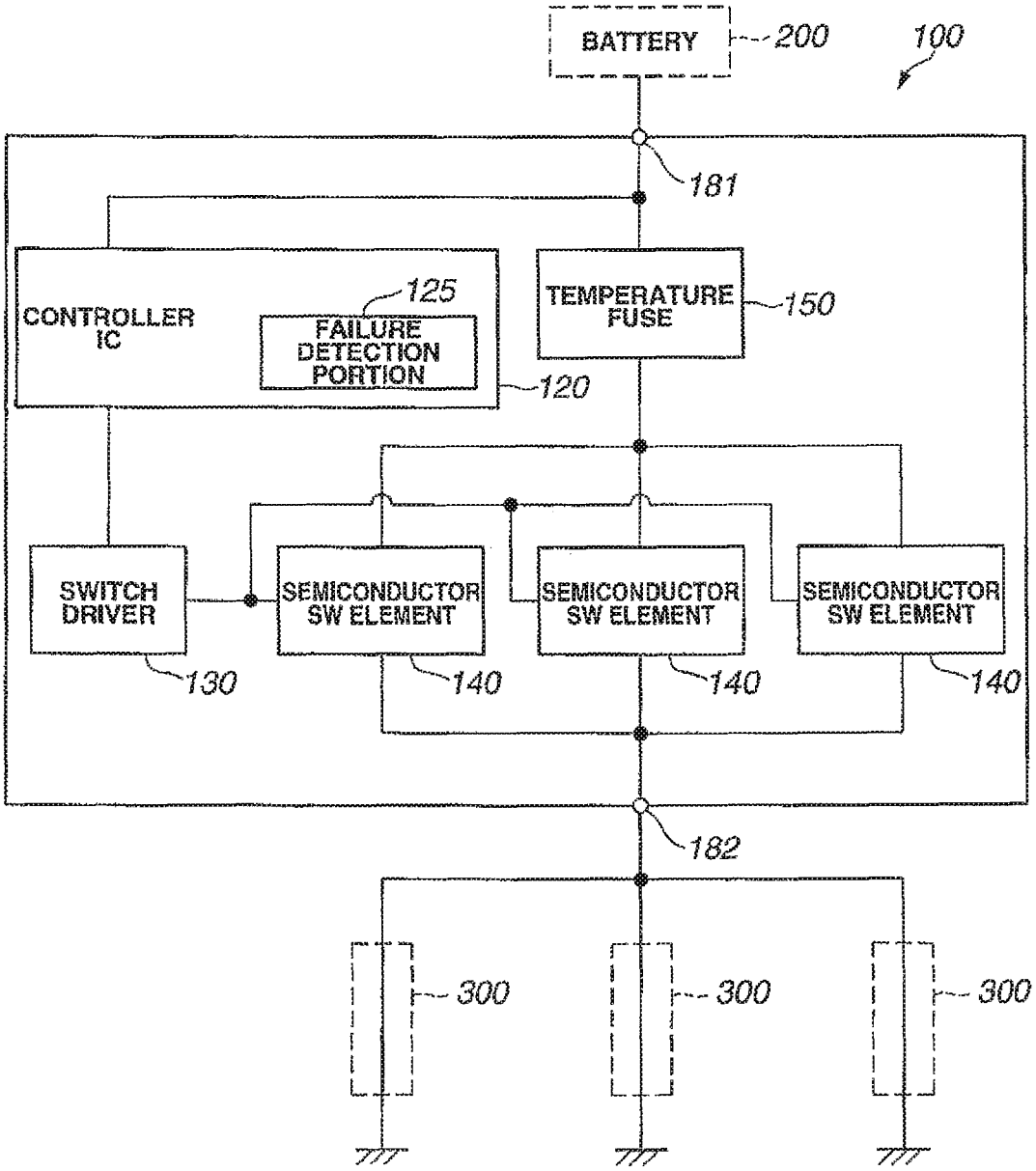
FIG. 1 is a block diagram of a glow plug control apparatus according to a first embodiment of the present invention.

FIG. 1 is a block diagram of a control apparatus 100 according to a first embodiment of the present invention. The control apparatus 100 is adapted to control the supply of power from an external battery 200 (as a power source) to glow plugs 300. Although three glow plugs 300 are connected electrically in parallel in the first embodiment, there is no particular limitation on the number of glow plugs 300. The number of glow plugs 300 can be set to any arbitrary number. The glow plugs 300 are grounded and used to aid ignition in a diesel engine.

As shown in FIG. 1, the control apparatus 100 has a power input terminal 181, a plurality of semiconductor switching elements 140 (in the first embodiment, three semiconductor switching elements), a plug connection terminal 182, a temperature fuse 150, a controller integrated circuit (IC) 120 and a switch driver 130 mounted on a substrate (not shown).

The power connection terminal 181 is connected to the battery 200 such that a constant external power voltage (direct-current voltage) is inputted from the battery 200 to the power connection terminal 181. This external power voltage is supplied to the controller IC 120 and to the temperature fuse 150 through a wiring pattern of the substrate.

The semiconductor switching elements 140 are provided as a power semiconductor device in the form of a surface mount integrated circuit (IC) package. Each of the semiconductor switching elements 140 includes a FET (field effect transistor) and, optionally, another component such as bipolar transistor. The semiconductor switching elements 140 can be integrated with the switch driver 130 as an IPD (intelligent power device). These semiconductor switching elements 140 are electrically connected in parallel to each other and are electrically connected at output terminals thereof to the plug connection terminal 182 through a wiring pattern of the substrate so as to make series connection with the glow plugs 300 and turn on and off the power supply to the glow plugs 300 according to drive signals from the controller IC 120. Although three semiconductor switching elements 140 are provided in the control apparatus 100 in the first embodiment, there is no particular limitation on the number of semiconductor switching elements 140 in the control apparatus 100. The number of semiconductor switching elements 140 in the control apparatus 100 can be set arbitrarily in view of the number of glow plugs 300 etc. because, when the number of semiconductor switching elements 140 is too small relative to the number of glow plugs 300, the semiconductor switching elements 140 are more likely to reach a high temperature.

The temperature fuse 150 is provided with a passive element and actuated by a temperature rise thereof. When the temperature fuse 150 is heated to a temperature higher than its actuation temperature, electrical connection inside the temperature fuse 150 is cut off to interrupt current flow. The passive element can be of the type having an electrical contact joined by a solder joint and capable of, when the solder joint is molten by the temperature rise, disconnecting the electrical contact with the application of mechanical stress by a spring such as coil spring. The passive element can alternatively be of any other type. The temperature fuse 150 has an input terminal to which the external battery 200 is electrically connected through the power input terminal 181 and an output terminal to which the semiconductor switching elements 140 are electrically connected in common through the wiring pattern. Thus, the power supply to the respective semiconductor switching elements 140 is interrupted by actuation of the temperature fuse 150. The actuation of the temperature fuse 150 for interruption of the power supply to the semiconductor switching elements 140 will be explained later in detail.

The controller IC 120 is provided as a control portion to perform ON/OFF drive control of the semiconductor switching elements 140 through the switch driver 130. In the first embodiment, the controller IC 120 is composed of a micro controller unit (MCU) so as to output the drive signals each having a duty ratio for PWM (pulse width modulation) control.

Further, a failure detection portion 125 is provided in the controller IC 120 so as to detect the occurrence of an ON failure in each of the semiconductor switching elements 140. As mentioned above, the "ON failure" refers to the status in which the semiconductor switching element 140 is failing while being in its ON state. In the first embodiment, the failure detection portion 125 checks an output voltage of the semiconductor switching element 140 and judges that the semiconductor switching element 140 is failing in the ON state when the output voltage is outputted from t semiconductor switching element 140 at the timing at which the semiconductor switching element 140 should be in an OFF state. Namely, the failure detection portion 125 detects the ON failure in the semiconductor switching element 140 when there is current flow in the semiconductor switching element 140 at the timing at which the semiconductor switching element 140 should be in the OFF state.

The switch driver 130 is provided with a drive circuit to drive the semiconductor switching elements 140 according to the drive signals from the controller IC 120. The switch driver 130 has an input terminal to which the controller IC 120 is electrically connected and an output terminal to which the semiconductor switching elements 140 are electrically connected in common.

In the first embodiment, the control apparatus 100 executes the following power supply control process so as to positively actuate the temperature fuse 150 and suppress abnormal overheating of the semiconductor switching elements 140 in the event of the ON failure in at least one of the semiconductor switching elements 140.

A-2. Power Supply Control Process

Figure 2:
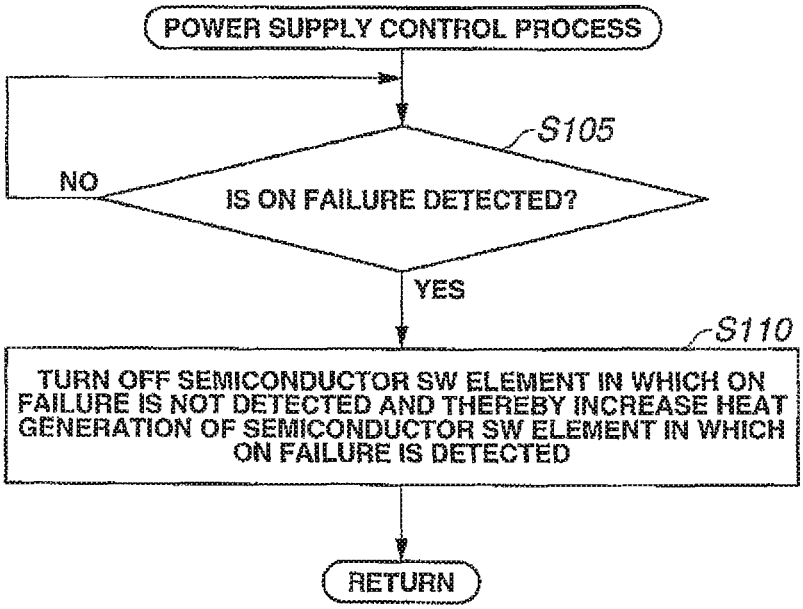
FIG. 2 is a flow chart for a power supply control process of the glow plug control apparatus according to the first embodiment of the present invention.

FIG. 2 is a flow chart for the power supply control process of the control apparatus 100. The control apparatus 100 turns on the three semiconductor switching elements 140 and supplies power from the battery 200 to the glow plugs 300 when heating of the glow plugs 300 is required by an external engine control unit. Simultaneously with initiation of the power supply from the battery 200 to the glow plugs 300, the control apparatus 100 starts the power supply control process shown in FIG. 2.

At step S105, the controller IC 120 (failure detection portion 125) judges whether the ON failure is detected in at least one of the semiconductor switching elements 140. When the ON failure is detected in none of the semiconductor switching elements 140 (NO at step S105), the process repeats step S105. When the ON failure is detected in at least one of the semiconductor switching elements 140 (YES at step S 105), the process goes to step S110.

At step S110, the controller IC 120 causes the switch driver 130 to turn off all of the semiconductor switching elements 140 in which the ON failure is not detected and thereby increases the amount of heat generation of the semiconductor switching elements 140 in which the ON failure is detected. The process then goes back to step S105.

Figure 3:
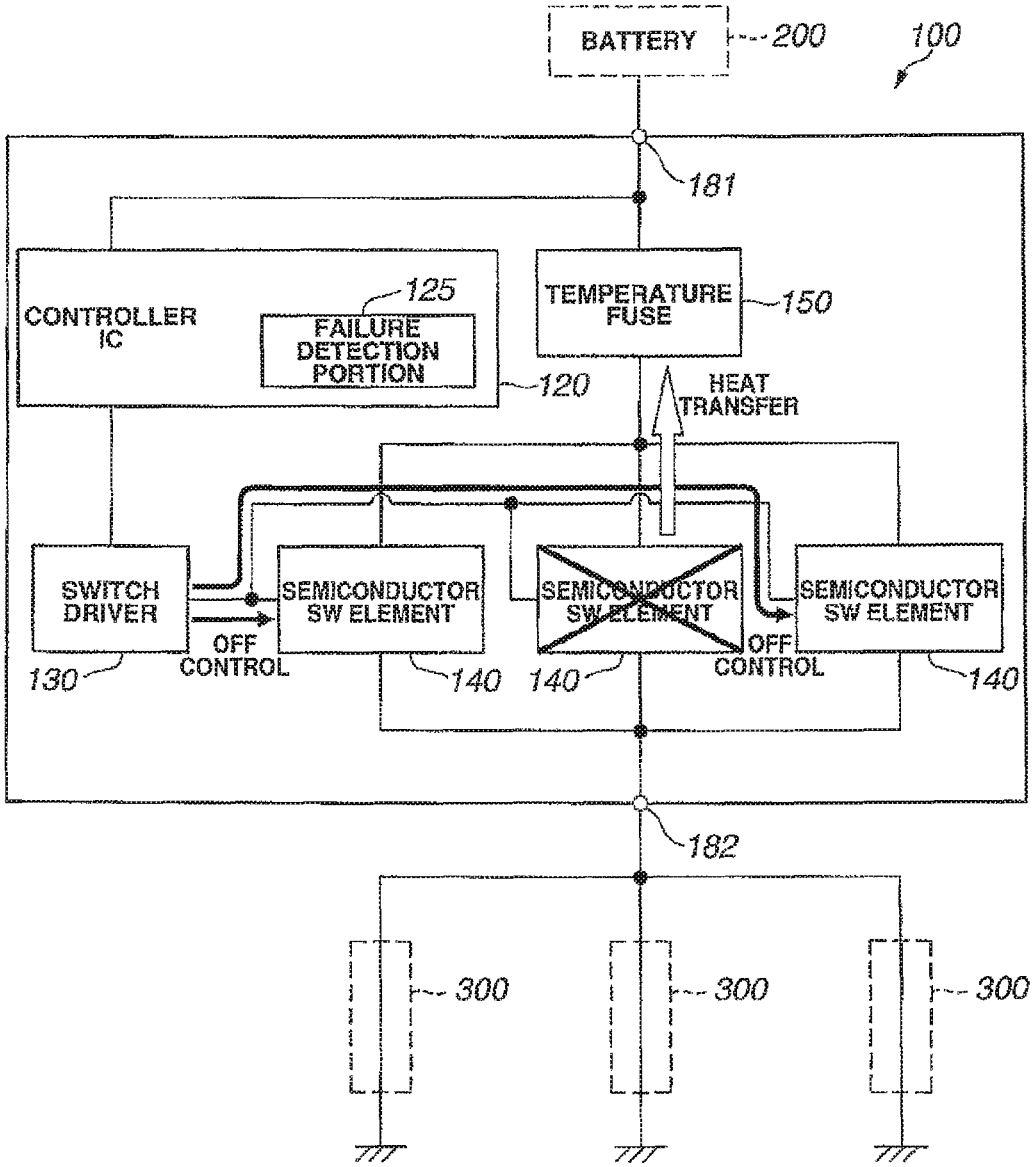
FIG. 3 is a schematic view showing an overview of the power supply control process of the glow plug control apparatus according to the first embodiment of the present invention.

FIG. 3 is a schematic diagram showing one operation example of the power supply control process of the control apparatus 100. It is now assumed that the ON failure is detected in one of the semiconductor switching elements 140 indicated by a cross in FIG. 3. In this case, all of two of the semiconductor switching elements 140 in which the ON failure is not detected is turned to the OFF state as indicated by solid line arrows in FIG. 3. As a result, the power supply is concentrated onto one of the semiconductor switching elements 140 in which the ON failure is detected. The amount of heat generation of such a failing semiconductor switching element 140 is consequently increased to increase the amount of heat transfer to the temperature fuse 150 as indicated by a hollow arrow in FIG. 3. When the temperature fuse 150 is heated to a temperature higher than its actuation temperature, the temperature fuse 150 is actuated to interrupt the power supply to the respective semiconductor switching elements 140. The actuation of the temperature fuse 150 is notified from the controller IC 120 to the external engine control unit. Then, the external engine control unit informs a user of the actuation of the temperature 150 by lightening of a lamp, indication of a message or the like.

As described above, the control apparatus 100 is configured to, upon detection of the ON failure in at least one of the semiconductor switching elements 140, to turn off any of the semiconductor switching elements 140 in which the ON failure is not detected and thereby increase the amount of heat generation of the semiconductor switching element 140 in which the ON failure is detected. With such increase of heat generation, it is possible to heat the temperature fuse 150 to a higher temperature and more stably actuate the temperature fuse 150, that is, possible to securely interrupt the power supply before burnout of the semiconductor switching elements 140 or the substrate by abnormal overheating. Since the control apparatus 100 is provided with one temperature fuse 150 to protect the plurality of semiconductor switching elements 140, it is possible to not only suppress increase in the production cost of the control apparatus 100 but also suppress increase in the area of the substrate and simplify the overall configuration of the control apparatus 100. It is further possible to improve the flexibility in the design of the substrate, without the need to arrange the temperature fuse 150 and the semiconductor switching elements 140 adjacent to each other, since the temperature fuse 150 is efficiently heated by the above power supply control process.

In the first embodiment, the semiconductor switching elements 140 are connected in parallel to each other and are connected in series to the electrically parallel glow plugs 300. In this arrangement, it is possible to concentrate a large amount of electric current on one of the semiconductor switching elements 140 and easily increase the amount of heat generation of such one semiconductor switching element 140 by turning off the other semiconductor switching elements 140.

The semiconductor switching element 140 in which the ON failure is occurring has a short circuit between its component parts and shows higher ON resistance than under normal conditions. In view of the fact that the amount of heat generation of the semiconductor switching element 140 is proportional to the resistance as indicated by the following equation (1), the semiconductor switching element 140 in which the ON failure is occurring can easily generate heat.

$$\text{Heat generation amount } (J) = [\text{Current } (A)]^2 \times \text{Resistance } (\Omega) \times \text{Time } (t) \quad (1)$$

It is thus possible to efficiently heat the temperature fuse 150 by increasing the amount of heat generation of the semiconductor switching element 140 that is likely to generate heat due to the occurrence of the ON failure.

As compared to the case where a reverse connection protection FET (field effect transistor) is used to cause heat generation by the passage of electric current through a parasitic diode of the reverse connection protection FET, it is easy to control the time lapsed until interruption of the power supply and thereby possible to more stably actuate the temperature fuse 150 for improvement in safety in the event of the ON failure in the semiconductor switching element 140. Since no dedicated component part or configuration is used to increase the amount of heat generation of the semiconductor switching element 140, it is possible to avoid increase in the production cost of the control apparatus 100.

B. Second Embodiment

Figure 4:
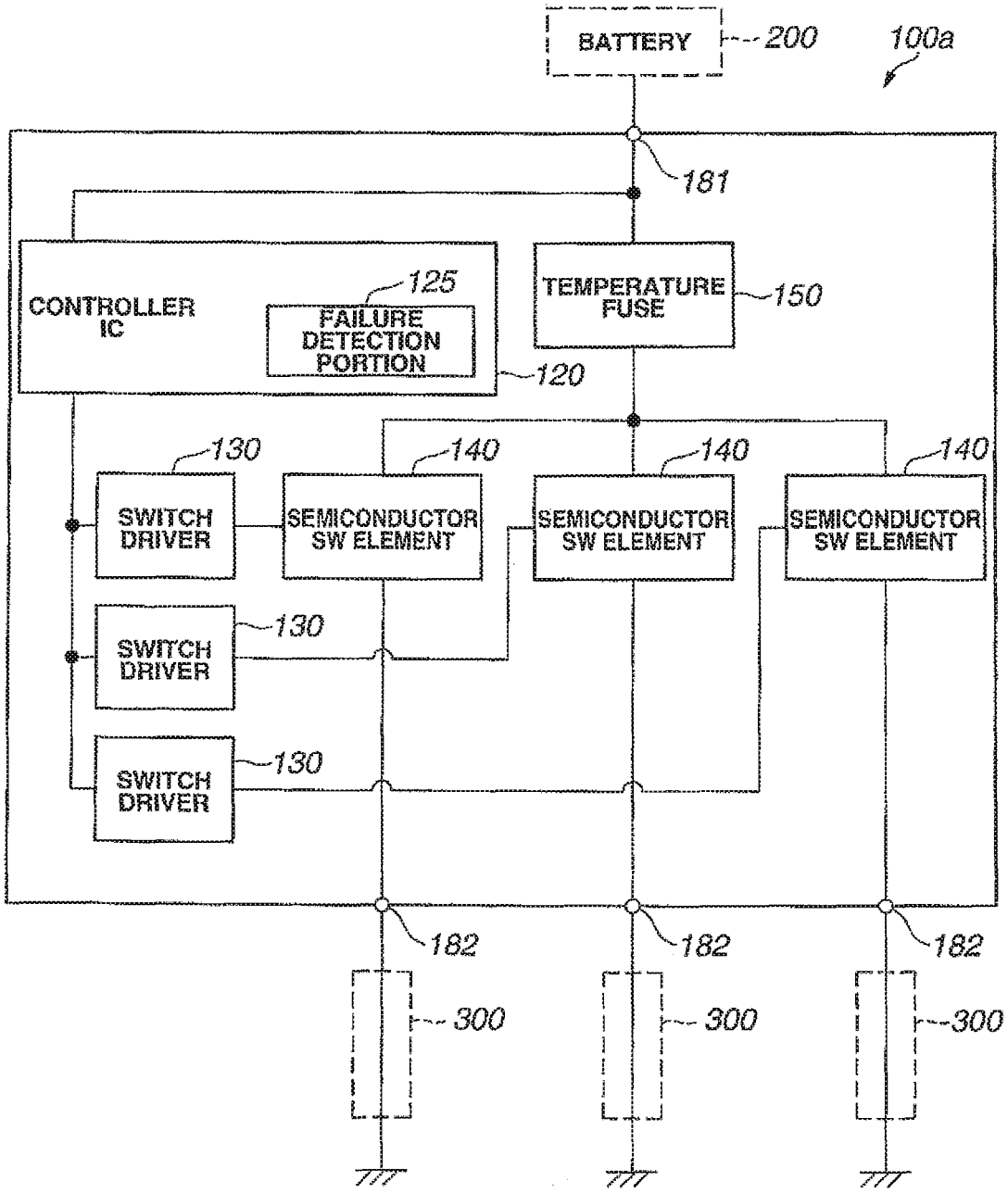
FIG. 4 is a block diagram of a glow plug control apparatus according to a second embodiment of the present invention.

FIG. 4 is a block view of a control apparatus 100*a* for glow plugs 300 according to a second embodiment of the present invention. The control apparatus 100*a* of the second embodiment is different from the control apparatus 100 of the first embodiment in its circuit system and power supply control process. The same configurations of the second embodiment as those of the first embodiment are designated by the same reference numerals; and explanations thereof will be omitted herefrom.

Differently from the control apparatus 100 of the first embodiment, the control apparatus 100*a* of the second embodiment has three parallel semiconductor switching elements 140 separately electrically connected in series to the respective glow plugs 300 through plug connection terminals 182 and three switch drivers 130 separately connected to the respective semiconductor switching elements 140 and equipped with drive circuits to drive the respective semiconductor switching elements 140 such that the semiconductor switching elements 140 independently turn on and off power supply to the respective glow plugs 300.

Figure 5:
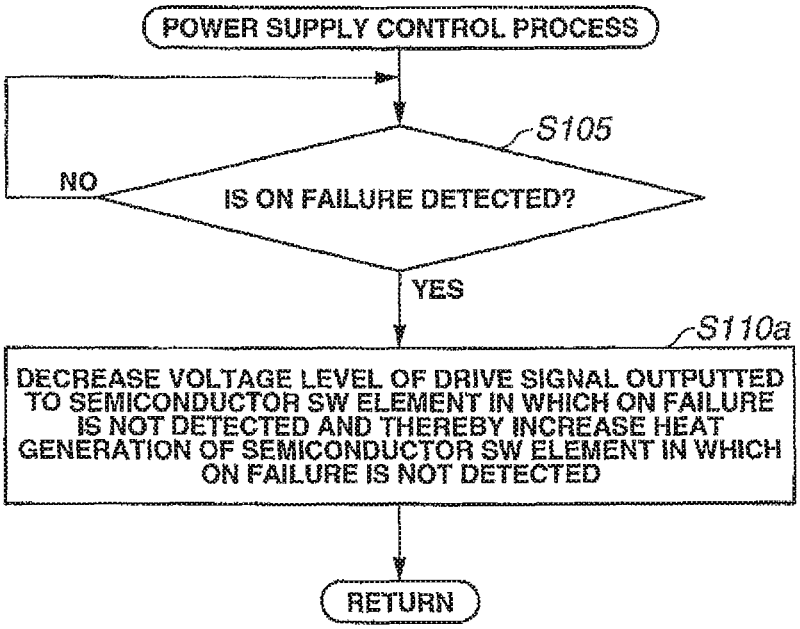
FIG. 5 is a flow chart for a power supply control process of the glow plug control apparatus according to the second embodiment of the present invention.
Figure 6:
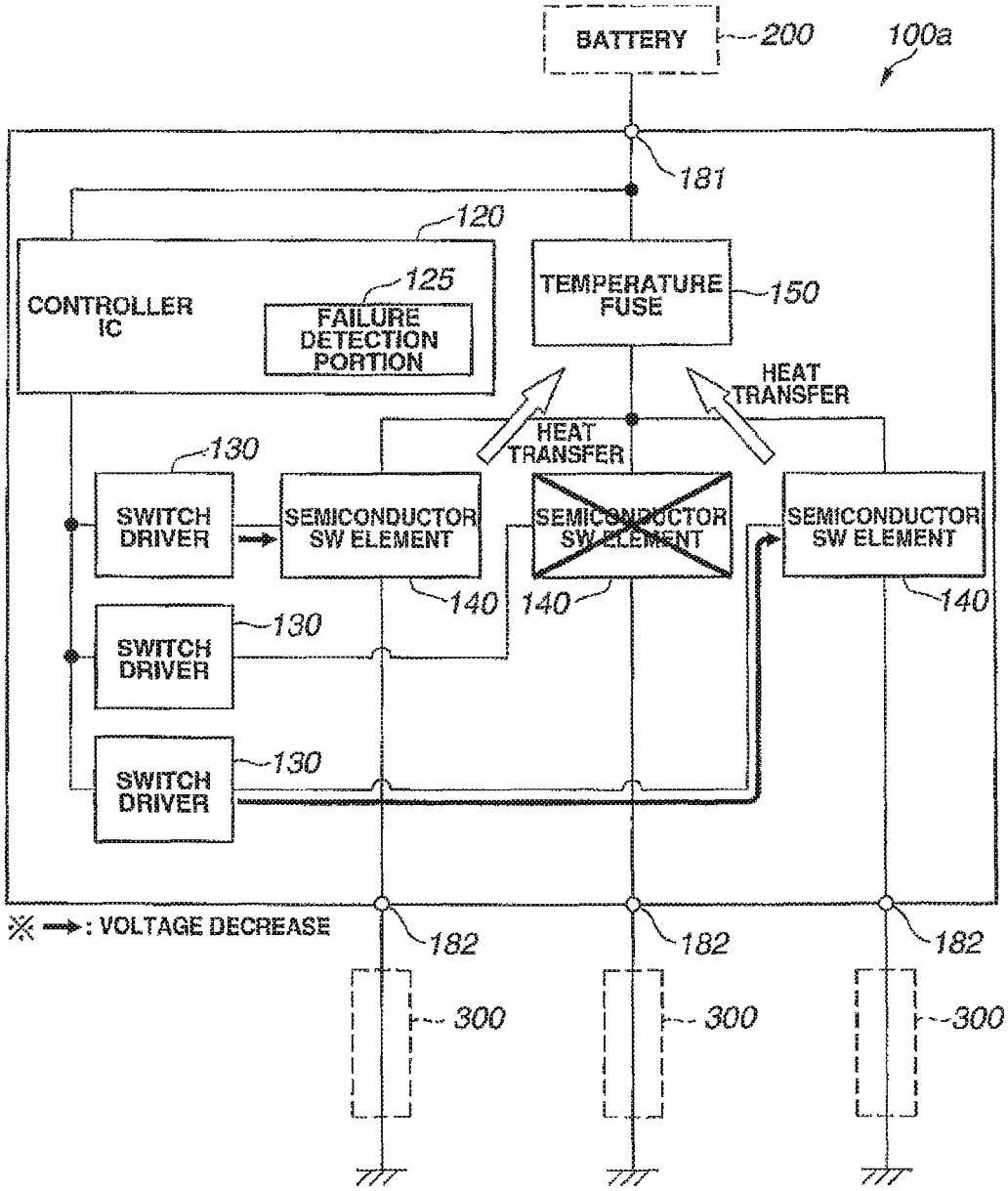
FIG. 6 is a schematic view showing an overview of the power supply control process of the glow plug control apparatus according to the second embodiment of the present invention.

FIG. 5 is a flow chart for a power supply control process of the control apparatus 100*a*. FIG. 6 is a schematic diagram showing one operation example of the power supply control process of the control apparatus 100*a*. The power supply control process of the control apparatus 100*a* of the second embodiment is different from the power supply control process of the control apparatus 100 of the first embodiment, in that the power supply control process is executed to increase the amount of heat generation of any of the semiconductor switching elements 140 in which the ON failure is not detected, rather than to increase the amount of heat generation of at least one of the semiconductor switching elements 140 in which the ON failure is detected, as shown in FIG. 5.

At step S105, the controller IC 120 (failure detection portion 125) judges whether the ON failure is detected in at least one of the semiconductor switching elements 140. When the ON failure is detected in none of the semiconductor switching elements 140 (NO at step S105), the process repeats step S105. When the ON failure is detected in at least one of the semiconductor switching elements 140 (YES at step SI 05), the process goes to step S110*a*.

At step S110*a*, the controller IC 120 decreases the voltage levels of the drive signals outputted to all of the semiconductor switching elements 140 in which the ON failure is not detected and thereby increases the amount of heat generation of these semiconductor switching elements 140 in which the ON failure is not detected. The process then goes back to step S105.

In the case where the ON failure is detected in one of the semiconductor switching elements 140 indicated by a cross in FIG. 6, the voltage levels of all of the drive signals outputted to the other two of the semiconductor switching elements 140 in which the ON failure is not detected is decreased to e.g. the same voltage level as indicated by solid line arrows in FIG. 6. It is preferable to decrease the voltage levels of the drive signals to be lower than a threshold voltage of the semiconductor switching elements 140. In the second embodiment, the voltage levels of the drive signals is decreased to he slightly lower than the threshold voltage of the semiconductor switching elements 140. In the case where the threshold voltage of the semiconductor switching clement 140 is 5V, for example, the voltage levels of the drive signals is set to a sufficiently higher level (e.g. 8V) under normal conditions and decreased to about 4 V by execution of the power supply control process. It is feasible to decrease the voltage levels of the drive signals by means of voltage divider circuits (not shown) or any other arbitrary means such as regulators.

As the voltage level of the drive signal outputted to the semiconductor switching element 140 is decreased, the amount of carriers fed through the semiconductor switching element 140 is limited to cause increase in the ON resistance of the semiconductor switching element 140. The power loss increases with increase in the ON resistance of the semiconductor switching element 140 so that the amount of heat generation of the semiconductor switching element 140 becomes increased according to the above equation (1). Consequently, the amount of heat transfer from the semiconductor switching elements 140 in which the ON failure is not detected to the temperature fuse 150 is increased, as indicated by a hollow arrow in FIG. 6, by decreasing the voltage levels of the drive signals outputted to these semiconductor switching elements 140. When the temperature fuse 150 is heated to a temperature higher than its actuation temperature, the temperature fuse 150 is actuated to interrupt the power supply to the respective semiconductor switching elements 140.

It is thus possible in the second embodiment to obtain the same effects as in the first embodiment. It is also possible to, even in the case where the glow plugs 300 are not electrically connected in parallel to each other, stably actuate the temperature fuse 150 by increasing the amount of heat generation of the semiconductor switching elements 140 in which the ON failure is not detected. Since the On resistance of the semiconductor switching elements 140 in which the ON failure is not detected increase with decrease in the voltage levels of the drive signals, it is possible to easily increase the amount of heat generation of these normally functioning semiconductor switching elements 140. In particular, it is possible to efficiently increase the amount of heat generation of the normally functioning semiconductor switching elements 140 by decreasing the voltage levels of the drive signals to be slightly lower than the threshold voltage of the semiconductor switching elements 140.

Since the amount of heat generation of the semiconductor switching elements 140 in which the ON failure is not detected is effectively increased by the above power supply control process, all of the semiconductor switching elements 140 are not necessarily arranged adjacent to the temperature fuse. It is thus possible to improve the flexibility in the design of the substrate.

Furthermore, it is possible to efficiently heat the temperature fuse 150 by increasing the amount of heat generation of all of the semiconductor switching elements 140 in which the ON failure is not detected.

C. Third Embodiment

A control apparatus 100*b* for glow plugs 300 according to a third embodiment of the present invention is different from the control apparatus 100*a* of the second embodiment in its power supply control process. The same configurations of the third embodiment as those of the second embodiment are designated by the same reference numerals; and explanations thereof will be omitted herefrom.

Figure 7:
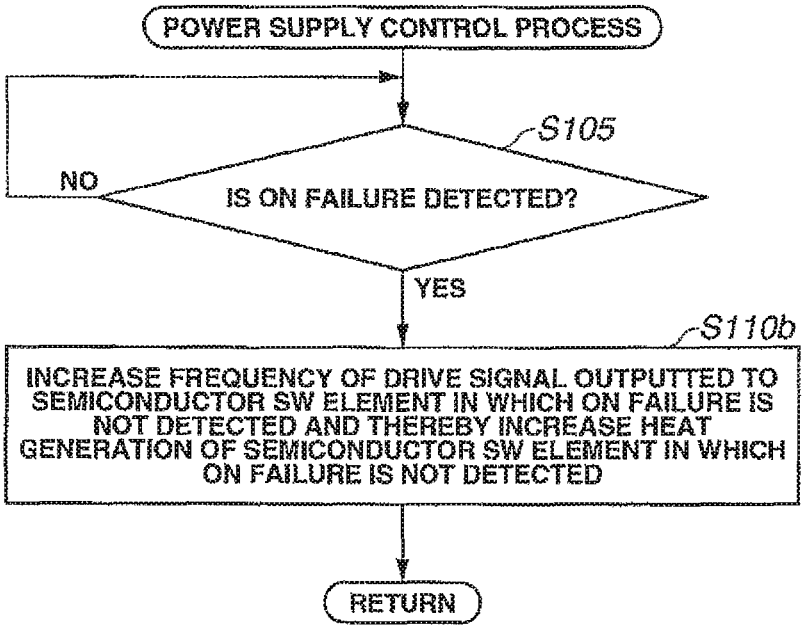
FIG. 7 is a flow chart for a power supply control process of a glow plug control apparatus according to a third embodiment of the present invention.
Figure 8:
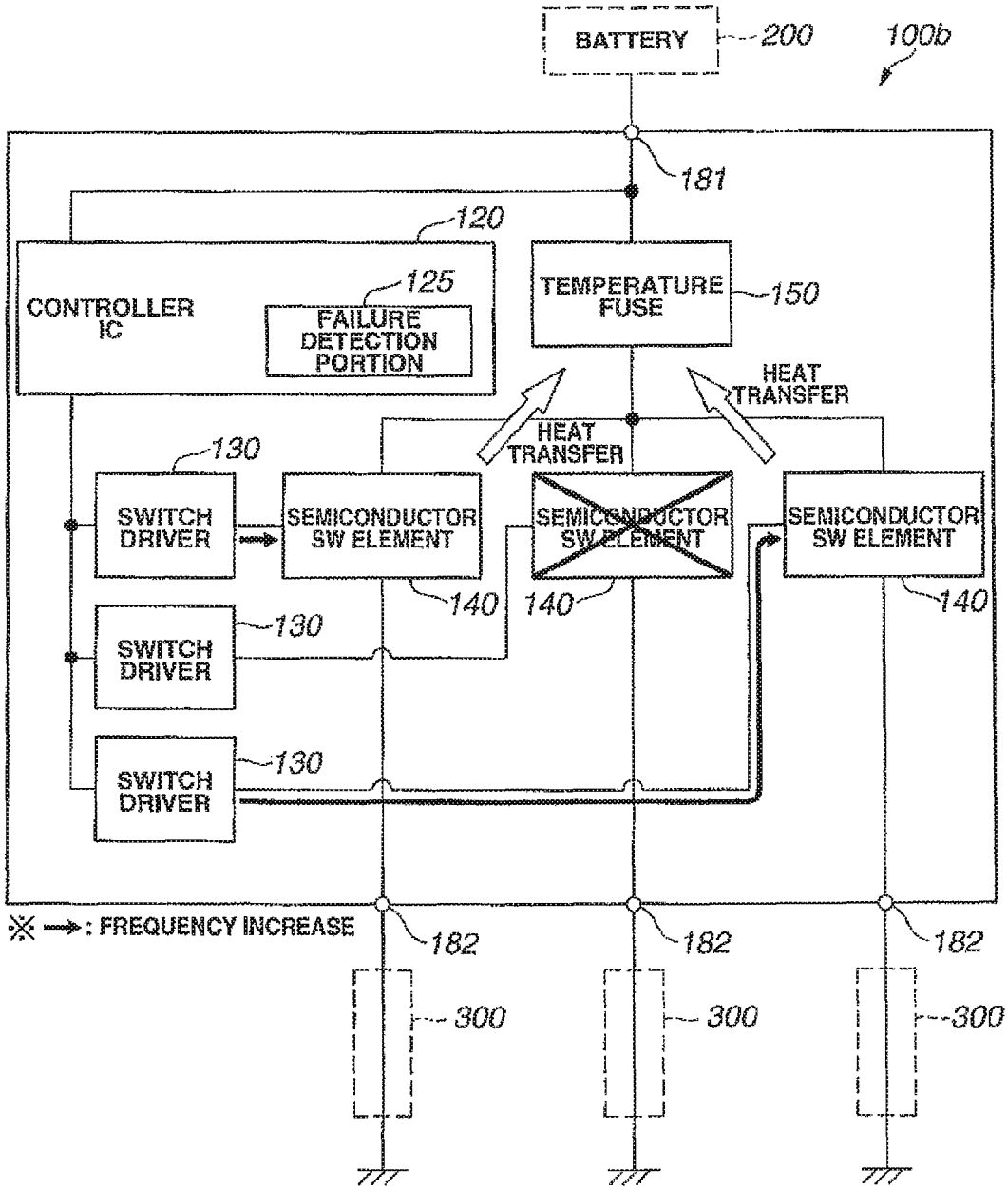
FIG. 8 is a schematic view showing an overview of the power supply control process of the glow plug control apparatus according to the third embodiment of the present invention.

FIG. 7 is a flow chart for a power supply control process of the control apparatus 100*b*. FIG. 8 is a schematic diagram showing one operation example of the power supply control process of the control apparatus 100*b*. The power supply control process of the control apparatus 100*b* of the third embodiment is different from the power supply control process of the control apparatus 100*a* of the second embodiment, in that the power supply control process is executed to increase the frequencies of the drive signals outputted to any of the semiconductor switching elements 140 in which the ON failure is not detected, rather than to decrease the voltage levels of the drive signals outputted to any of the semiconductor switching elements 140 in which the ON failure is not detected, as shown in FIG. 6.

At step S105, the control apparatus 100 (failure detection portion 125) judges whether the ON failure is detected in at least one of the semiconductor switching elements 140. When the ON failure is detected in none of the semiconductor switching elements 140 (NO at step S105), the process repeats step S105. When the ON failure is detected in at least one of the semiconductor switching elements 140 (YES at step S105), the process goes to step S110*b*.

At step S110*b*, the control apparatus 100 increases the frequencies of the drive signals outputted to all of the semiconductor switching elements 140 in which the ON failure is not detected and thereby increases the amount of heat generation of these semiconductor switching elements 140 in which the ON failure is not detected. The process then goes back to step S105.

In the case where the ON failure is detected in one of the semiconductor switching elements 140 indicated by a cross in FIG. 8, the frequencies of all of the drive signals outputted to the other two of the semiconductor switching elements 140 in which the ON failure is not detected increased as indicated by solid line arrows in FIG. 8. It is preferable to increase the frequencies of the drive signals to be twice or more higher, more preferably five times or more higher, still more preferably, ten times or more higher, than that under normal conditions. In the third embodiment, the frequencies of the drive signals is increased to be ten times higher than that under normal conditions. In the ease where the frequencies of the drive signals is set to 40 Hz under normal conditions, for example, the frequencies of the drive signals is increased to 400 Hz by execution of the power supply control process.

As the frequency of the drive signal outputted to the semiconductor switching element 140 is increased, the number of ON/OFF switching operations of the semiconductor switching element 140 is increased. The switching loss of the semiconductor switching element 140 increases with increase in the number of ON/OFF switching operations so that the amount of heat generation of the semiconductor switching element 140 becomes increased. Consequently, the amount of heat transfer from the semiconductor switching elements 140 in which the ON failure is not detected to the temperature fuse 150 is increased, as indicated by a hollow arrow in FIG. 8, by increasing the frequencies of the drive signals outputted to these semiconductor switching elements 140. When the temperature fuse 150 is heated to a temperature higher than its actuation temperature, the temperature fuse 150 is actuated to interrupt the power supply to the respective semiconductor switching elements 140.

It is thus possible in the third embodiment to obtain the same effects as in the second embodiment. It is also possible to increase the the switching loss of the semiconductor switching elements 140 in which the ON failure is not detected and easily increase the amount of heat generation of these normally functioning semiconductor switching elements 140 in the third embodiment. In particular, it is possible to efficiently increase the amount of heat generation of the normally functioning semiconductor switching elements 140 by increasing the frequencies of the drive signals to be ten times higher than that under normal conditions. Furthermore, it is possible to eliminate the voltage divider circuits, simplify the overall configuration of the control apparatus 100*c* and avoid increase in the production cost of the control apparatus 100*b*.

D. Modifications

D-1. First Modification

In the first embodiment, the control apparatus 100 turns off all of the semiconductor switching elements 140 in which the ON failure is not detected by execution of the power supply control process. Alternatively, the control apparatus 100 may turn off a part (at least one) of the semiconductor switching elements 140 in which the ON failure is not detected. Further, the semiconductor switching elements 140 in which the ON failure is not detected are not necessarily turned to the full OFF state. It is feasible to increase the amount of heat generation of the semiconductor switching element 140 in which the ON failure is detected by shortening the time of the ON state of the semiconductor switching elements 140 in which the ON failure is not detected and thereby decreasing the amount of electric current through the semiconductor switching elements 140 in which the ON failure is not detected. Even in these configurations, it is possible to obtain the same effects as in the first embodiment.

D-2. Second Modification

In the second and third embodiments, the control apparatus 100*a*, 100*b* increases the amount of heat generation of all of the semiconductor switching elements 140 in which the ON failure is not detected by execution of the power supply control process. The control apparatus 100*a*, 100*b* may alternatively increases the amount of heat generation of a part (at least one) of the semiconductor switching elements 140 in which the ON failure is not detected (for example, one of the semiconductor switching elements 140 located closest to the temperature fuse 150). Even in this configuration, it is possible to obtain the same effects as in the second and third embodiments. It is further possible to eliminate a part of the voltage divider circuits in the control apparatus 100*a* and suppress increase in the production cost of the control apparatus 100*a*.

D-3. Third Modification

Although the control apparatus 100*a* decreases the voltage levels of the drive signals to be slightly lower than the threshold voltage of the semiconductor switching elements 140 in the second embodiment, the control apparatus 100*a* may decrease the voltage levels of the drive signals to any other value lower than that under normal conditions (e.g. higher than the threshold voltage of the semiconductor switching elements 140). Similarly, the control apparatus 100*b* may increase the frequencies of the drive signals to any other level higher than that under normal conditions in the third embodiment. Even in they configurations, it is possible to obtain the same effects as in the second and third embodiments.

D-4. Fourth Modification

Although the control apparatus 100*a* decreases the voltage levels of the drive signals to the same value in the second embodiment, the control apparatus 100*a* may decrease the voltage levels of the drive signals to different values by varying the respective amounts of decrease of the drive signals. Similarly, the control apparatus 100*b* may increase the frequencies of the drive signals to different levels by varying the respective amounts of increase of the drive signals. Even in these configurations, it is possible to obtain the same effects as in the second and third embodiments.

D-5. Fifth Modification

The circuit configurations of the control apparatuses 100*a* and 100*b* of the second and third embodiments may be the same as the circuit configuration of the control apparatus 100 of the first embodiment.

The entire contents of Japanese Patent Application No. 2015-127347 (filed on Jun. 25, 2015) are herein incorporated by reference.

The present invention is not limited to the above specific embodiments and can be embodied in various forms without departing from the scope of the present invention. For example, it is possible to appropriately replace or combine any of the technical features mentioned above in "Summary of the Invention" and "Description of the Embodiments" in order to solve, part or all of the above-mentioned problems or achieve part or all of the above-mentioned effects. Any of these technical features, if not explained as essential in the present specification, may be eliminated as appropriate. The scope of the invention is defined with reference to the following claims.

Having described the invention, the following is claimed:

1. A control apparatus for controlling a power supply to a glow plug, comprising:

a power source configured to provide the power supply to the glow plug;

a plurality of semiconductor switching elements electrically connected to the power source and to the glow plug, the semiconductor switching elements being configured to turn on and off the power supply from the power source to the glow plug;

a temperature fuse arranged between the power source and the semiconductor switching elements and actuated by a temperature rise thereof, the temperature fuse being configured to interrupt the power supply to the semiconductor switching elements when actuated by a rise in temperature thereof by the semiconductor switching elements; and a control portion configured to output drive signals for ON/OFF drive control of the semiconductor switching elements, the control portion comprising a failure detection portion configured to detect an occurrence or non-occurrence of an ON failure in each of the semiconductor switching elements, the control portion being further configured to, when the failure detection portion detects the ON failure in at least one of the semiconductor switching elements, output the drive signals to control any of the semiconductor switching elements in which no ON failure is detected to increase an amount of heat generated by either the at least one of the semiconductor switching elements in which the ON failure is detected or the any of the semiconductor switching elements in which no ON failure is detected.

2. The control apparatus according to claim 1, wherein the glow plug is one of a plurality of the glow plugs connected electrically in parallel to each other;

wherein the semiconductor switching elements are electrically connected in parallel to each other and are electrically connected in series to the glow plugs; and wherein the control portion is further configured to, when the failure detection portion detects the ON failure in at least one of the semiconductor switching elements, output the drive signals to turn off the any of the semiconductor switching elements in which no ON failure is detected to increase the amount of heat generated by the at least one of the semiconductor switching elements in which the ON failure is detected.

3. A control apparatus for controlling a power supply to a plurality of glow plugs, comprising:

a power source configured to provide the power supply to the glow plug;

a plurality of semiconductor switching elements electrically connected to the power source, in parallel to each other, and respectively in series to the glow plugs, the semiconductor switching elements being configured to turn on and off the power supply from the power source to the glow plugs;

a temperature fuse arranged between the power source and the semiconductor switching elements, the temperature fuse being configured to interrupt the power supply to the semiconductor switching elements when actuated by a rise in temperature thereof by the semiconductor switching elements; and a control portion configured to output drive signals for ON/OFF drive control of the semiconductor switching elements, the control portion comprising a failure detection portion that detects the occurrence or non-occurrence of an ON failure in each of the semiconductor switching elements, the control portion being further configured to, when the failure detection portion detects the ON failure in at least one of the semiconductor switching elements, output the drive signals to control any of the semiconductor switching elements in which no ON failure is detected to increase an amount of heat generated by at least one of the any of the semiconductor switching elements in which no ON failure is detected.

4. The control apparatus according to claim 3, wherein the control portion is further configured to, when the failure detection portion detects the ON failure in the at least one of the semiconductor switching elements, decrease a voltage level of the drive signal outputted to the at least one of the any of the semiconductor switching elements in which no ON failure is detected to increase the amount of heat generated by the at least one of the any of the semiconductor switching elements in which no ON failure is detected.

5. The control apparatus according to claim 3, wherein the control portion is further configured to, when the failure detection portion detects the ON failure in the at least one of the semiconductor switching elements, output the drive signals increase a frequency of the drive signal outputted to the at least one of the any of the semiconductor switching elements in which no ON failure is detected to increase increases the amount of heat generated by the at least one of the any of the semiconductor switching elements in which no ON failure is detected.

6. A control method for controlling power supply from a power source to a glow plug by means of a control apparatus, the control apparatus comprising:

a plurality of semiconductor switching elements electrically connected to the power source and to the glow plug so as to turn on and off the power supply from the power source to the glow plug; and a temperature fuse arranged between the power source and the semiconductor switching elements and actuated by a temperature rise thereof by the semiconductor switching elements so as to interrupt the power supply to the semiconductor switching elements, the control method comprising:

(a) detecting the occurrence or non-occurrence of an ON failure in each of the semiconductor switching elements; and (b) when the ON failure is detected in at least one of the semiconductor switching elements in the step (a), controlling any of the semiconductor switching elements in which no ON failure is detected to increase an amount of heat generated by either the at least one of the semiconductor switching elements in which the ON failure is detected or the any of the semiconductor switching elements in which no ON failure is detected.

* * * * *